United States Patent [19]

Lapointe

[11] 4,155,385

[45] May 22, 1979

[54] LOG-SPLITTING DEVICE

[76] Inventor: Roland Lapointe, Rte. 2, Winthrop, Me. 04364

[21] Appl. No.: 890,322

[22] Filed: Mar. 27, 1978

Related U.S. Application Data

[63] Continuation-in-part of Ser. No. 756,951, Jan. 5, 1977, Pat. No. 4,111,246.

[51] Int. Cl.[2] ..... B27L 7/00

[52] U.S. Cl. ..... 144/193 A

[58] Field of Search ..... 144/3 K, 193 R, 193 A, 144/323

[56] References Cited

U.S. PATENT DOCUMENTS 4,073,325 2/1978 Krom, Jr. ..... 144/193 A

*Primary Examiner*—Gary L. Smith
*Assistant Examiner*—W. D. Bray
*Attorney, Agent, or Firm*—William Nitkin

[57] ABSTRACT

Power log-splitting apparatus utilized as an accessory to back hoe-equipped power equipment comprising a base, an upright member affixed to the base with means for affixing the upright member to the stick member of the back hoe with a wedge member affixed to the piston of the back hoe. Rail means are provided within which the wedge member is guided into a log to be split, and stabilizing means, affixed to the upright member, is adapted to prevent tilting of the base while the log splitter is in use.

3 Claims, 5 Drawing Figures

LOG-SPLITTING DEVICE

BACKGROUND OF THE INVENTION

This application is a continuation-in-part of my previous pending application for Log-splitting Accessory for Back Hoe Power Equipment, Ser. No. 756,951, filed Jan. 5, 1977, now U.S. Pat. No. 4,111,246.

The device of this invention relates to the splitting of logs and more particularly to power-driven log-splitters.

Power-driven log-splitting devices have long been in use. They fall in various categories, some of which may be characterized by devices such as described in U.S. Pat. No. 3,285,304 of O. C. Fuller which incorporates an hydraulic piston mounted on a framework adapted to force a wedge into the log to be split. U.S. Pat. No. 3,280,864 by O. C. Spanenberg discloses a similar device having an hydraulic piston forcing the log against a wedge thereby causing its splitting. U.S. Pat. No. 3,779,295 by Balsbaugh discloses a device utilizing an hydraulic piston forcing a wedge into the log to be split wherein the operative mechanism is tiltable on a frame so that one may not necessarily have to lift the log up into the mechanism, but can merely stand the log on the base for splitting. There are several devices such as characterized in U.S. Pat. No. 3,319,675 to M. J. Bles, Sr.; U.S. Pat. No. 3,356,115 to H. J. Cole; U.S. Pat. No. 3,760,854 to Worthington; and U.S. Pat. No. 3,938,567 to Dickerson, all of which are accessories to tractor units containing various embodiments of mechanisms for the splitting of logs and which usually fit as accessories toward the rear of the tractor. A device which fits at the front of a tractor in lieu of a front end loader bucket is disclosed in U.S. Pat. No. 3,780,779 to Guy. Disclosed is an hydraulic piston forcing the log into a wedge at the base of an arm member. A wood-splitting attachment for a back hoe is disclosed in U.S. Pat. No. 4,019,549 to Williams.

SUMMARY

It is an object of this invention to provide a power log-splitter which is utilized as an accessory to power equipment having a back hoe arm. The apparatus of this invention contains no hydraulic parts in its construction and can be attached directly to a back hoe to function utilizing the back hoe's boom and stick in their regular mode of operation including the utilization of the hydraulics of the back hoe's boom and stick. The body of the present invention is affixed to the stick member of the back hoe, and the wedge of the present invention is connected to the hydraulic piston rod, positioned substantially parallel to the boom's stick. The wedge moves upward or downward according to the movement of the piston rod which is actuated hydraulically through the hydraulic tubes interconnected to control levers on the back hoe's body. As the wedge moves upward or downward, its movement is channeled within rail members. Logs to be split are placed on the base of the frame in vertical alignment with the wedge which is then forced downward into the log to split same. The apparatus of this invention functions with superior power and ease in splitting logs and can be economically manufactured.

DESCRIPTION OF THE PREFERRED EMBODIMENT

Figure 1:
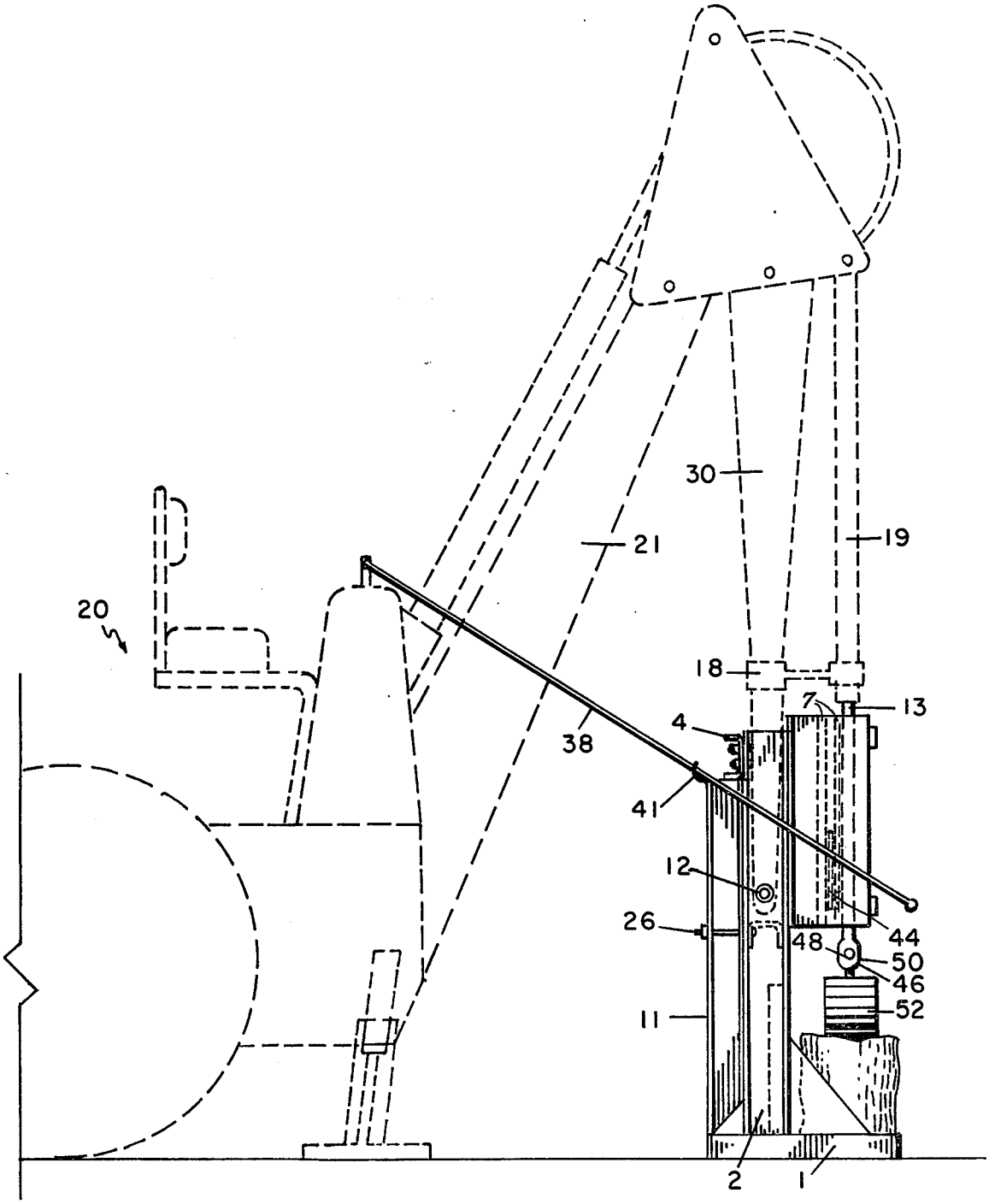
FIG. 1 illustrates a side view of the device of this invention in use with a back hoe.
Figure 4:
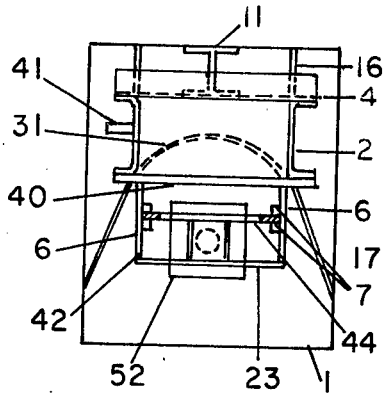
FIG. 4 illustrates a top view of the device of this invention with wedge in place.
Figure 2:
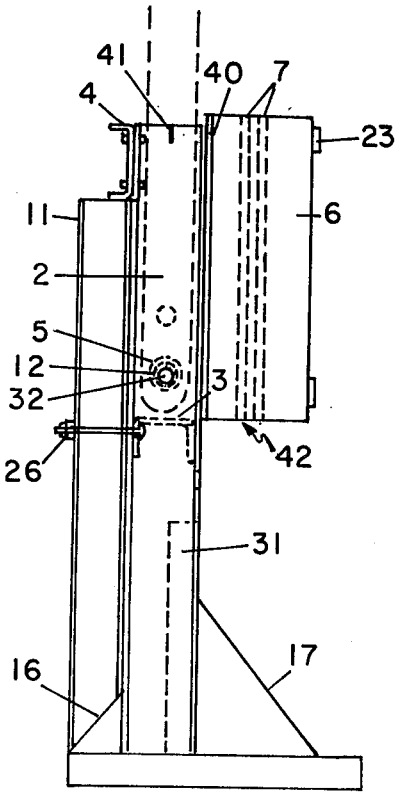
FIG. 2 illustates a side view of the device of this invention with wedge member removed.

FIG. 1 illustrates the device of this invention in use attached to a back hoe stick 30 shown in outline form along with back hoe 20 and boom 21. FIG. 2 is an enlarged view of the device of this invention showing back hoe stick 30 inserted into the device of this invention and affixed thereto by pin 32 extending through the lower aperture 5 in the base of stick 30 and into horizontally corresponding apertures 12 in upright members 2. The aperture usually located above lower aperture 5 on stick 30 seen in outline form is not utilized in this invention. The device's two upright members 2 are spaced apart from one another a distance sufficient to insert stick 30 therebetween although a somewhat wider spacing can be utilized. These upright members 2 are affixed to base 1 and can be reinforced for additional strength such as by gusset members 16 and 17. Extending from base 1 upwards and running between the two upright members 2 is curved plate 31. This plate is also seen in FIG. 4 wherein its inward concavity is more clearly illustrated. Curved plate 31 prevents logs from being forced between upright members 2 as they are being split thereby keeping them on the working area of base 1. At the top rear of upright members 2 and extending therebetween and affixed thereto is brace beam 4. Extending behind upright members 2 from brace beam 4 to base 1 is strong bar 11 which can be an I-beam centrally disposed between and to the rear of upright members 2. Strong bar 11 acts as a stabilizing means. A strong bar brace member 3 which extends between upright members 2 and is affixed thereto can be affixed to strong bar 11 by bolts directly to the inner portions of the I-beam of strong bar 11 or by equivalent means of affixation. One other method of affixation illustrated herein can be by bolts extending on either side of strong bar 11 from strong bar brace 3 through strong bar rear support member 26 which extends across the rear of strong bar 11 and is affixed by nuts to the bolts, thereby attaching the strong bar firmly in position. Wedge assembly support plate 40 is affixed to the front upper portion of upright members 2 and extends completely thereacross. To this wedge assembly support plate 40 is affixed wedge carrier assembly 42 which consists of two rail support members 6 affixed to the wedge assembly support plate 40 by welding or equivalent means and have disposed on their inner sides wedge rails 7 adapted so that the wedge assembly can slide up and down therebetween. Brace beam 4, wedge assembly support plate 40, and strong bar 11 all interact to prevent angular movement of stick member 30 by enclosing it in a structure in which it can have no angular movement in relation to the device of this invention. Further rail support members 6 and associated wedge rails 7 allow the wedge assembly to be maneuvered in parallel relation only to upright members 2 when it is attached to and moved by the piston rod and forced into a log positioned vertically on base 1 of the device of this invention. It has been found helpful to utilize a collar member 18 to hold the piston member 19 and the stick in permanent alignment to one another so that they will not move apart during the operation of the device of this invention. Collar member 18 also seen in FIG. 1 consists of plates and bolt members or any equivalent thereto to prevent the piston and stick 30 from spreading apart. Rail support members 6 can extend somewhat forward of wedge rails 7 and can have one or more rail support front bars 23 extending horizontally across the front thereof joining the two members for additional strength. FIG. 1 also illustrates control rod 38 used with the device of this invention. Attached at one end to the hydraulic control activating the upward and downward movement of the piston member rod 13 and wedge affixed thereto, control rod 38 runs through retaining hook member 41 positioned upon the body of the log-splitting device which positioning prevents it from falling to the ground and also allows the operator of the device to position a log upon the device and activate the log-splitting mechanism without having to walk back to the back hoe controls. The operator merely manipulates control rod 38 from a position where he can, if he desires, support the log initially until the wedge is engaged with the log. Once the wedge is engaged with the log, the splitting process proceeds smoothly. The operator can cause the wedge to lift by maneuvering the control rod 38 from his position near the log-splitting activity.

Figure 3:
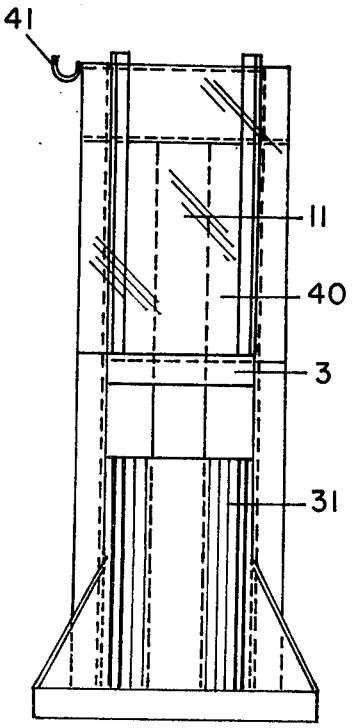
FIG. 3 illustrates a front view of the device of this invention.

FIG. 3 illustrates a front view of the device showing curved plate 31 and wedge assembly support plate 40 in position and strong bar 11 centrally located behind upright members 2 extending up to brace beam 4.

FIG. 4 shows a top view of the device of this invention with wedge in position illustrating strong bar 11 and brace beam 4 and also the relationship of wedge carrier assembly 42 and wedge member 52 in position to slide up and down within wedge rails 7 on the inside of rail support members 6. Also seen is rail support front bar 23 extending across the front between the rail supports.

Figure 5:
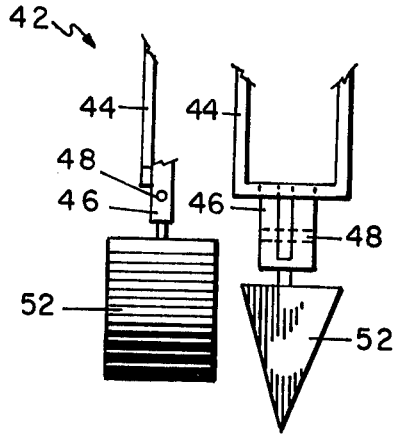
FIG. 5 illustrates side and front views of the wedge member.

FIG. 5 illustrates front and side views of the wedge showing the wedge slide members 44 which travel within wedge rails 7. Wedge slide members 44 are affixed to wedge support members 46 which have defined therein aperture 48 for interconnection with the rod 13 of piston member 19 by insertion of a pin through aperture 48 and through the aperture 50 at the end of piston rod member 13 when disposed therebetween. Wedge member 52 is affixed to wedge support members 46.

The device of this invention can be completely fabricated of welded steel parts or equivalent strong metal.

Although the present invention has been described with reference to particular embodiments, it will be apparent to those skilled in the art that variations and modifications can be substituted therefor without departing from the principles and spirit of the invention.

I claim:

1. A power log-splitting apparatus that is an accessory to back hoe-equipped power equipment of the type having a boom member, a stick member pivotally attached to said boom member, and an hydraulically controlled piston rod member mounted parallel to said stick member, said apparatus comprising in combination:

a base;

a pair of upright members affixed to said base;

connecting means for affixing said upright members to said stick member of said back hoe;

a wedge member;

means to affix said wedge member to said piston rod member;

rail means affixed to said upright members for guiding said wedge member;

a brace member joining said upright members at a point above the location of said connecting means of said upright members and said stick;

an elongated strong bar member vertically disposed parallel to and between said upright members and further disposed to the rear of said connecting means of said upright members and said stick; and a wedge assembly support plate affixed between said upright members at a point to the front of said stick when said stick is affixed to said upright members and upon which wedge assembly support plate is mounted said rail means.

2. The device of claim 1 further including a curved plate affixed to and extending between said upright members in proximity to said upright members affixation to said base.

3. The device as recited in claim 1 further including:

a retaining member mounted upon said device; and a control rod having a first and second end, the first end of which adapted to be attached to said piston arm member's hydraulic control member and which control rod is further adapted to have a portion thereof supported by said retaining member when retained thereby and having its second end being then reachable by the operator of the log-splitting apparatus while in its immediate vicinity.

* * * * *